US010960316B2

(12) United States Patent
Cardona Rivera

(10) Patent No.: US 10,960,316 B2
(45) Date of Patent: Mar. 30, 2021

(54) GYROSCOPIC DESK CURIOS

(71) Applicant: Mechanical Design Labs, Inc., Chicago, IL (US)

(72) Inventor: Jose Cardona Rivera, Chicago, IL (US)

(73) Assignee: Mechanical Design Labs, Inc., Chicago, IL (US)

( * ) Notice: Subject to any disclaimer, the term of this patent is extended or adjusted under 35 U.S.C. 154(b) by 0 days.

(21) Appl. No.: 16/501,427

(22) Filed: Apr. 12, 2019

(65) Prior Publication Data

US 2020/0324215 A1 Oct. 15, 2020

(51) Int. Cl.

| | |
|---|---|
| ***A63H 1/02*** | (2006.01) |
| ***A63H 31/10*** | (2006.01) |
| ***A63H 29/24*** | (2006.01) |

(52) U.S. Cl.

CPC ..... *A63H 1/02* (2013.01); *A63H 29/24* (2013.01); *A63H 31/10* (2013.01)

(58) Field of Classification Search

CPC . A63H 1/00; A63H 1/02; A63H 29/24; A63H 31/10

USPC ..... 446/239, 256, 259, 260, 261, 262, 263, 446/264

See application file for complete search history.

(56) References Cited

U.S. PATENT DOCUMENTS

| | | | | | |
|---|---|---|---|---|---|
| 579,174 | A * | 3/1897 | Palmer | A63H 1/04 | 446/263 |
| 884,391 | A * | 4/1908 | Johansson | A63H 1/02 | 446/260 |
| 990,130 | A * | 4/1911 | Heider | A63H 1/04 | 446/263 |
| 2,039,819 | A * | 5/1936 | Marx | A63H 1/24 | 446/22 |
| 2,078,729 | A * | 4/1937 | Lemoine | G09B 23/10 | 446/233 |
| 2,402,463 | A | 6/1946 | Sullivan | | |
| 2,452,730 | A | 11/1948 | Carter | | |
| 2,493,834 | A * | 1/1950 | Sanders | A63H 1/00 | 446/233 |
| 2,561,601 | A * | 7/1951 | Szonnell | A63H 1/04 | 446/263 |
| 2,762,162 | A * | 9/1956 | Doljan | A63H 1/00 | 446/233 |
| 2,937,472 | A * | 5/1960 | Cunningham | A63H 1/04 | 446/263 |
| 3,119,621 | A | 1/1964 | Bookman | | |

(Continued)

*Primary Examiner* — Joseph B Baldori

(74) *Attorney, Agent, or Firm* — Paul E Schaafsma; NovusIP, LLC

(57) ABSTRACT

In accordance with the principals of the present invention, a desk or executive curio is provided. A rotor assembly includes a rotor and a shaft. A housing assembly defines inner pivoted supports that allow rotation of the rotor about an inner pivotal axis. The housing assembly further defines outer pivoted supports that allow rotation of the housing about an outer pivotal axis perpendicular to the inner pivotal axis of the rotor assembly. Bearings allow the rotor assembly and the housing assembly to be held in an axis perpendicular to a rotor axis. The rotor assembly and the housing assembly are removably connectable to a base along the inner pivotal axis, the base having an offset center of gravity and defining a curved outer surface.

12 Claims, 4 Drawing Sheets

(56) References Cited

U.S. PATENT DOCUMENTS

| | | | | | |
|---|---|---|---|---|---|
| 3,137,966 | A * | 6/1964 | Lohr | A63H 1/00 | 446/233 |
| 3,168,315 | A | 2/1965 | Bookman | | |
| 3,299,563 | A * | 1/1967 | Arboladura | A63H 1/04 | 446/263 |
| 3,594,925 | A | 7/1971 | Abbat | | |
| 4,538,999 | A * | 9/1985 | Orlowski | A63H 1/02 | 446/259 |
| 4,654,989 | A | 4/1987 | Fleming | | |
| 4,891,031 | A * | 1/1990 | Beaudry | A63H 1/00 | 446/256 |
| 5,026,057 | A * | 6/1991 | Watford | A63H 1/02 | 273/108 |
| 5,158,462 | A | 10/1992 | Hones et al. | | |
| 6,612,895 | B2 * | 9/2003 | Sze | A63H 1/00 | 446/233 |
| 6,853,283 | B1 | 2/2005 | French | | |
| 6,937,125 | B1 | 8/2005 | French | | |
| 7,018,263 | B2 | 3/2006 | Tiefel et al. | | |
| 8,926,396 | B2 | 1/2015 | Lennon | | |
| 9,180,379 | B2 | 11/2015 | Choi | | |
| 9,302,191 | B2 * | 4/2016 | Robustelli | A63H 1/30 | |
| 9,501,952 | B2 | 11/2016 | Mitchell, Jr. | | |
| 9,616,351 | B2 | 4/2017 | Choi | | |
| 9,643,095 | B2 | 5/2017 | Choi | | |
| 9,737,820 | B2 | 8/2017 | Cai | | |
| 9,849,394 | B1 | 12/2017 | Shindo | | |
| 9,914,063 | B1 | 3/2018 | McCoskery | | |
| 9,950,556 | B1 * | 4/2018 | Laemle | B43K 29/00 | |
| 10,029,185 | B2 | 7/2018 | Cai | | |
| 10,080,975 | B2 | 9/2018 | Choi | | |
| 10,118,103 | B2 | 11/2018 | Muraki | | |
| 10,137,380 | B2 | 11/2018 | Choi | | |
| 10,245,518 | B2 | 4/2019 | Horikoshi et al. | | |

* cited by examiner

GYROSCOPIC DESK CURIOS

FIELD OF THE INVENTION

The present invention relates to desk or executive curios.

BACKGROUND OF THE INVENTION

Many workers who toil at a desk seek to personalize work spaces to make it their own. In addition to photographs, gifts, mementos, and plants, desk, office or executive curios for the office can add some interest to a day's work. Desk curios provide some amusement to break the stress of a workday and inspire creativity. Desk curios can also spark conversations with co-workers, customers, and clients, and help to convey a worker's "personal brand". Donald Albrecht, Curator of Architecture and Design and the Museum of the city of New York and organizer of an exhibition in 2000 called "On the Job: Design and the American Office" at the National Building Museum in Washington, has called such curios "aspirational" and foghorns of identity and status in a sea of corporate homogeneity." Julie Lasky "Designing Distraction: Executive Toys" (The New York Times, 4 Feb. 2015) (accessed 18 Mar. 2019).

Drinking birds, insatiable birdies, dunking birds, drinky birds or dipping birds, are another example of desk curios. Drinking birds are a demonstration of a heat engine. A drinking bird consists of two glass bulbs joined by a glass tube, which comprises the neck of the bird. The tube extends nearly all the way into the bottom bulb and attaches but does not extend into to the top bulb. The space inside the bird contains a fluid with a low boiling point, which gives the heat engine the ability to extract motion from low temperatures, such as dichloromethane, also known as methylene chloride. Miles V. Sullivan's U.S. Pat. No. 2,402,463 (18 Jun. 1946) patent suggested ether, alcohol, carbon tetrachloride, or chloroform. Air is removed from the apparatus during manufacture, so the space inside the body is filled by vapor evaporated from the fluid. The upper bulb is covered with a felt material that comprises the birds head, with a beak, eyes, a top hat, and tail feathers. The two glass bulbs pivots on an adjustable crosspiece attached to the neck.

The drinking bird exploits a temperature difference to convert heat energy to a pressure difference within the device. As a heat engine, the drinking bird works through a thermodynamic cycle. In the initial state of the cycle, the felt is moistened and the head is oriented vertically. As the water evaporates from the felt on the head, the evaporation lowers the temperature of the glass head. The temperature decrease causes some of the dichloromethane vapor in the head to condense. The lower temperature and condensation cause the pressure to drop in the head. The higher vapor pressure in the warmer base pushes the liquid up the neck. As the liquid rises, the bird becomes top heavy and tips over. When the bird tips over, the bottom end of the neck tube rises above the surface of the liquid. A bubble of warm vapor rises up the tube through this gap, displacing liquid. Liquid flows back to the bottom bulb. Pressure equalizes between top and bottom bulbs. The weight of the liquid in the bottom bulb restores the bird to its vertical position. The liquid in the bottom bulb is heated by ambient air, which is at a temperature slightly higher than the temperature of the bird's head. A glass of water is placed so that the beak dips into the water and absorbs water to keep the head wet.

The drinking bird exploits several physical laws, including the combined gas law, which establishes a proportional relationship between temperature and pressure exerted by a gas in a constant volume; the ideal gas law, which establishes a proportional relationship between number of gas particles and pressure in a constant volume; the Maxwell-Boltzmann distribution, which establishes that molecules in a given space at a given temperature vary in energy level and exist in multiple phases at a single temperature; and heat of vaporization (or condensation), which establishes that substances absorb (or give off) heat when changing state at a constant temperature.

Subject to U.S. Pat. No. 2,452,730 to Albert C Carter (2 Nov. 1948) and U.S. Pat. No. 3,119,621 (28 Jan. 1964) and U.S. Pat. No. 3,168,315 (2 Feb. 1965) to Abe C Bookman, the Magic 8 Ball is a hollow plastic sphere resembling an oversized, black-and-white 8-ball. Inside, a cylindrical reservoir contains a white, plastic icosahedron floating in alcohol dyed dark blue. Each of the 20 faces of the die has an affirmative, negative or non-committal statement printed in raised letters. These messages are read through a window on the bottom of the ball. To use the ball, the window initially faces down. After asking a yes or no question, the ball is turned so that the window faces up, setting in motion the liquid and die inside. When the die floats to the top, one face presses against the window, the raised letters of the die displace the blue liquid to reveal the message as white letters on a blue background.

Newton's cradle, Newton's Balls or Executive Ball Clicker is an example of desk curios. Newton's cradle is a demonstration of 17th-century English scientist Sir Isaac Newton's law of conservation of momentum as well as the law of conservation of energy. A typical Newton's cradle consists of five or seven identically sized metal balls suspended by thin threads to two parallel horizontal bars in a perfectly straight line with the balls just touching each other. Each ball is hung from the frame by two thin threads of equal length angled away from each other to restrict the ball movements to the same plane. When one ball at the end is lifted and released, that ball strikes the stationary spheres, transmitting a force through the stationary spheres that pushes the last sphere upward. The last sphere swings back and strikes the still nearly stationary spheres, repeating the effect in the opposite direction. Various variations of Newton's cradle have been patented, including U.S. Pat. No. 9,501,952 to Mitchell, Jr.; U.S. Pat. No. 5,158,462 to Hones et al.; and U.S. Pat. No. 3,594,925 to Abbat.

Pin art, pinscreen, pinpressions or pinhead is a desk curios patented by Ward Fleming as U.S. Pat. No. 4,654,989 (7 Apr. 1987). Pin art consists of a boxed surface made of a crowded array of pins that are free to slide in and out independently in a screen to create a three-dimensional relief.

A more recent entry into the market is described in U.S. Pat. Nos. 6,853,283 and 6,937,125. Sold under the trademark MOVA® globe, this desk curio is a small plastic model typically of the Earth. In fact, there are two globes—an outer sphere of clear plastic and an inner sphere with the printed map. A thin layer of clear liquid separates the two spheres. If the MOVA globe is placed on a level surface and allowed to sit quietly for a few seconds, the inner globe will begin to rotate slowly, seemingly without any source of propulsion.

In fact, the globe is solar powered. Light enters through the printed material of the inner globe and powers hidden circuitry. Also concealed within the inner globe are bars or "spokes" that cross at the center and are attached to the inner surface of the printed sphere around the globe's equator. When a set of these bars is energized, the bars generate a magnetic field. This magnetic field then tries to align with the Earth's magnetic field. The inner globe spins in an effort to "point" north. After a few seconds, the inner circuitry shuts off the first set of energized bars and energizes a different pair. This new set of magnetized bars again tries to point north and the globe spins a bit more. Like an electric motor, this constant switching from one set of bars to another keeps the internal globe spinning.

The inner globe is floating in two different liquids. Both fluids are clear but have different densities—the heavier fluid sinks to the bottom and the lighter fluid rises. The inner globe is dense enough to stay in between these two fluids, so the inner globe does not sink to the bottom of the outer clear plastic sphere or float to the top, thus keeping friction to a minimum.

Thus, what would be beneficial would be desk curio that would help workers to personalize work spaces to make it their own. It would be further beneficial for a desk curio to add some interest to a day's work and provide some amusement to break the stress of a workday and inspire creativity. It would be further beneficial for a desk curio to spark conversations with co-workers, customers, and clients, and help to convey a worker's "personal brand".

SUMMARY OF THE INVENTION

A desk or executive curio in accordance with the principals of the present invention helps workers to personalize work spaces to make it their own. A desk or executive curio in accordance with the principals of the present invention adds some interest to a day's work and provides some amusement to break the stress of a workday and inspire creativity. A desk or executive curio in accordance with the principals of the present invention sparks conversations with co-workers, customers, and clients, and helps convey a worker's "personal brand".

In accordance with the principals of the present invention, a desk or executive curio is provided. A rotor assembly includes a rotor and a shaft. A housing assembly defines inner pivoted supports that allow rotation of the rotor about an inner pivotal axis. The housing assembly further defines outer pivoted supports that allow rotation of the housing about an outer pivotal axis perpendicular to the inner pivotal axis of the rotor assembly. Bearings allow the rotor assembly and the housing assembly to be held in an axis perpendicular to a rotor axis. The rotor assembly and the housing assembly are removably connectable to a base along the inner pivotal axis, the base having an offset center of gravity and defining a curved outer surface.

This Summary introduces concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The Detailed Description refers to the following accompanying drawings.

DETAILED DESCRIPTION OF AN EMBODIMENT

In accordance with the principals of the present invention, a gyroscopic curio is provided. A gyroscope is a device typically used for measuring or maintaining orientation and angular velocity. A gyroscope comprises a spinning rotor, wheel or disc in which the axis of rotation (spin axis) is free to assume any orientation. When rotating, the orientation of this axis is unaffected by tilting or rotation of the mounting, according to the conservation of angular momentum. Gyroscopes can be used to construct gyrocompasses, which complement or replace magnetic compasses (in ships, aircraft, spacecraft), assist in stability (bicycles, motorcycles, scooters) or as part of an inertial guidance system.

In more detail, a gyroscope is a rotor mounted in two or three gimbals, which are pivoted supports that allow the rotation of the rotor about a single axis. A set of three gimbals, one mounted on the other with orthogonal pivot axes, may be used to allow a rotor mounted on the innermost gimbal to have an orientation remaining independent of the special orientation of its support. In the case of a gyroscope with two gimbals, the outer gimbal, which is the gyroscope frame, is mounted so as to pivot about an axis in its own plane determined by the support. This outer gimbal possesses one degree of rotational freedom and its axis possesses none. The inner gimbal is mounted in the gyroscope frame (outer gimbal) so as to pivot about an axis in its own plane that is always perpendicular to the pivotal axis of the gyroscope frame (outer gimbal). This inner gimbal has two degrees of rotational freedom.

The axle of the spinning rotor defines the spin axis. The rotor is constrained to spin about an axis, which is always perpendicular to the axis of the inner gimbal. So the rotor possesses three degrees of rotational freedom and its axis possesses two. The rotor responds to a force applied to the input axis by a reaction force to the output axis.

A gyroscope will roll or resist about the output axis depending upon whether the output gimbals are free or fixed. The center of gravity of the rotor can be in a fixed position. The rotor simultaneously spins about one axis and is capable of oscillating about the two other axes, and it is free to turn in any direction about the fixed point (except for its inherent resistance caused by rotor spin).

Figure 1:
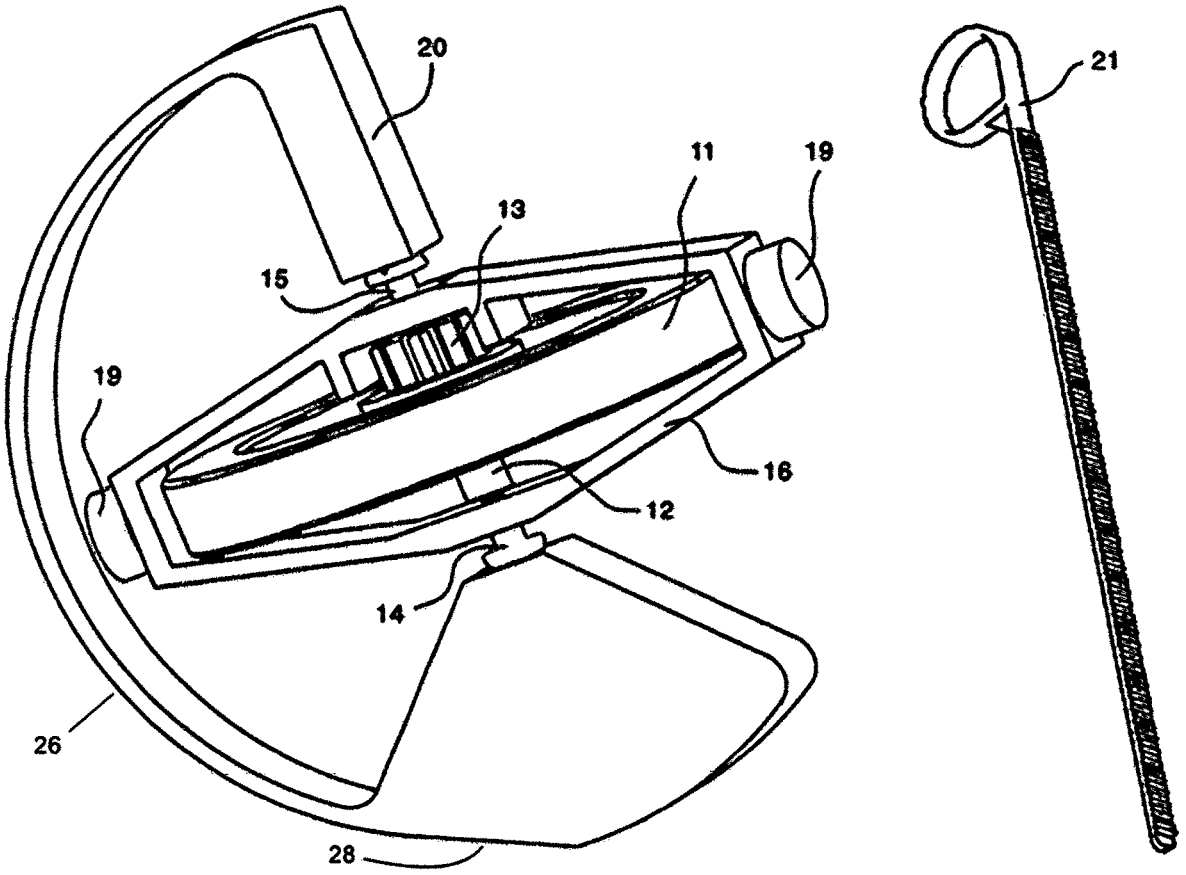
FIG. 1 is a perspective view of an example embodiment of a gyroscopic curio in accordance with the principals of the present invention.
Figure 2:
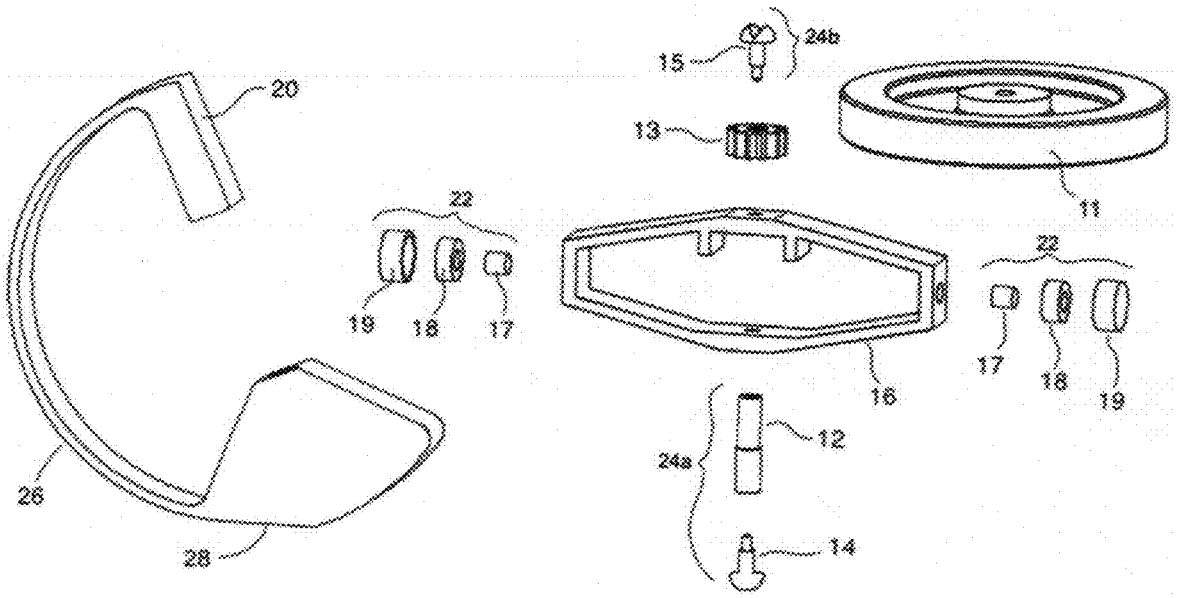
FIG. 2 is a partially exploded view of the gyroscopic curio of FIG. 1.
Figure 3A:
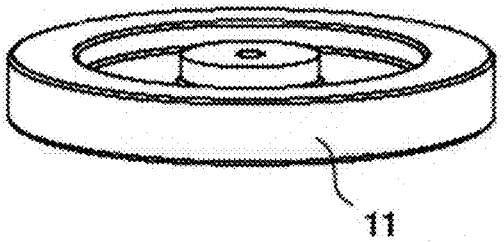
FIGS. 3A and 3B are upper and lower views of a rotor of the gyroscopic curio of FIG. 1.
Figure 3B:
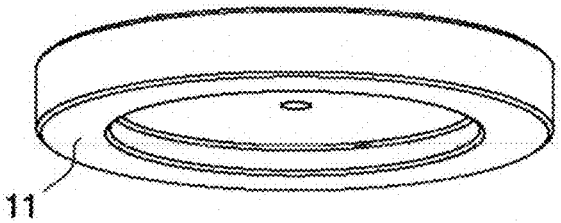
Figure 4:
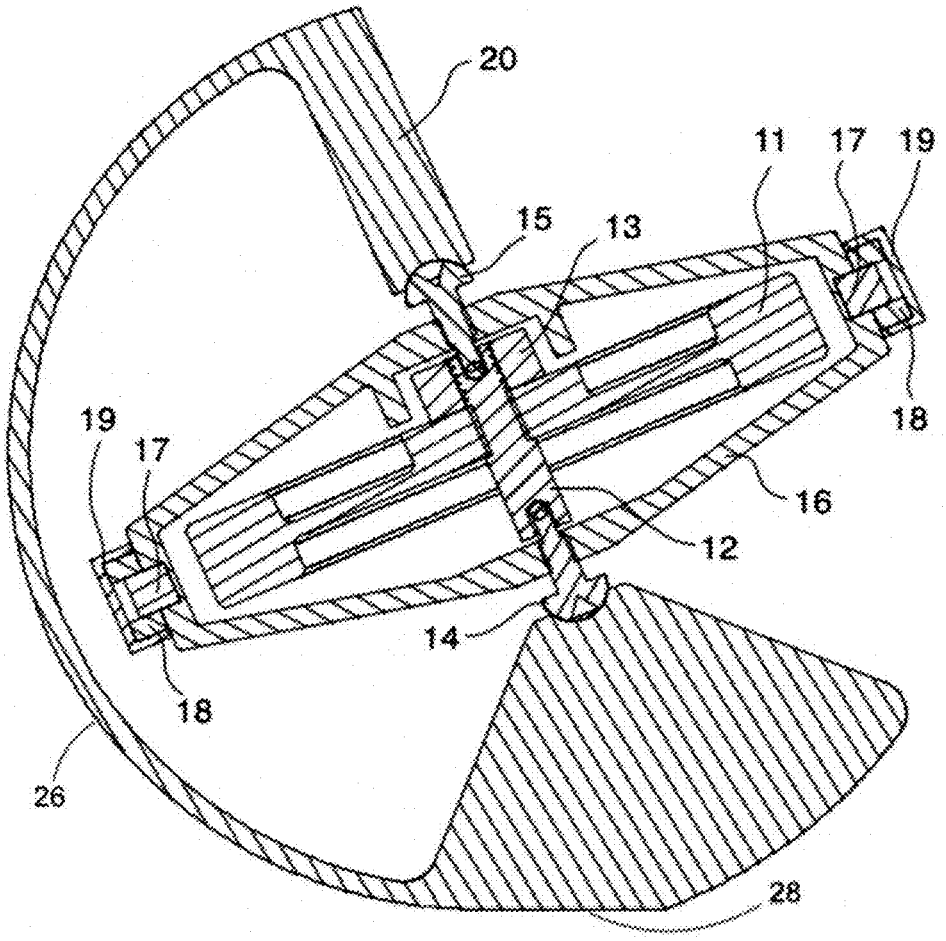
FIG. 4 is a cross-sectional view of the gyroscopic curio of FIG. 1.

Referring now to the Figures, an example embodiment of a desk or executive curio in accordance with the principles of the present invention is seen. As best seen in FIGS. 3A and 3B, a rotor 11 is provided defining a threaded center hole, with the majority of the mass of the rotor 11 located near the outer radius. A gear 13 is provided further defining the threaded center hole. Inner pivoted supports 24*a,b* are provided. Best seen in FIG. 2, the inner pivoted supports 24*a,b* can comprise a threaded shaft 12 and threaded gimbal shafts 14, 15. The threaded shaft 12 can be provided defining small holes at either end. The threaded shaft 12 can be threaded into the rotor 11 and the gear 13 to form a rotor assembly. Two threaded gimbal shafts 14, 15 can be provided, one threaded gimbal shaft 14 with a bulbous end defining a center hole and one pin-like end, the other threaded gimbal shaft 15 with a bulbous end defining a V-shaped cutout and a pin-like end. The gimbal shafts 14, 15 can be threaded into housing 16 through top and bottom threaded holes defined in housing 16 to form the housing assembly. The rotor assembly can be aligned inside the housing 16 and the two gimbal shafts 14, 15 are threaded deeper until the pin ends enter the two holes on the end of the shaft 12.

Two side shafts 17 are press fit into two holes defined on the sides of housing 16. Two side bearings 18 are press fit into the two side shafts 17 (seen in FIG. 2). Two cylinders 19 are press fit over the two side bearings 18. Housing or a base 20 is provided with the center area cleared out; one threaded hole is defined at the top and a second threaded hole is defined at the bottom; one round cutout is defined on either side; two flat parallel sides protrude into the center of the housing. The base 20 includes a thin curved outer surface 26 having a flattened surface section 28 thereof; the center of gravity of the curio is offset to the side and corresponds with the flattened surface section 28; two round cutouts are defined. The gyroscopic assembly is fit into the base 20 by pulling on the base 20 until it temporarily deforms to allow the two gimbal shafts 14, 15 to fit into the cutouts defined in the base 20 and releasing the base 20 so the base 20 springs back into place, locking the gyroscopic assembly in place. A rip cord 21 is provided with a long rack gear. The rip cord 21 is inserted in the assembly between the gear 13 and the flats on the housing 16.

Figure 5:
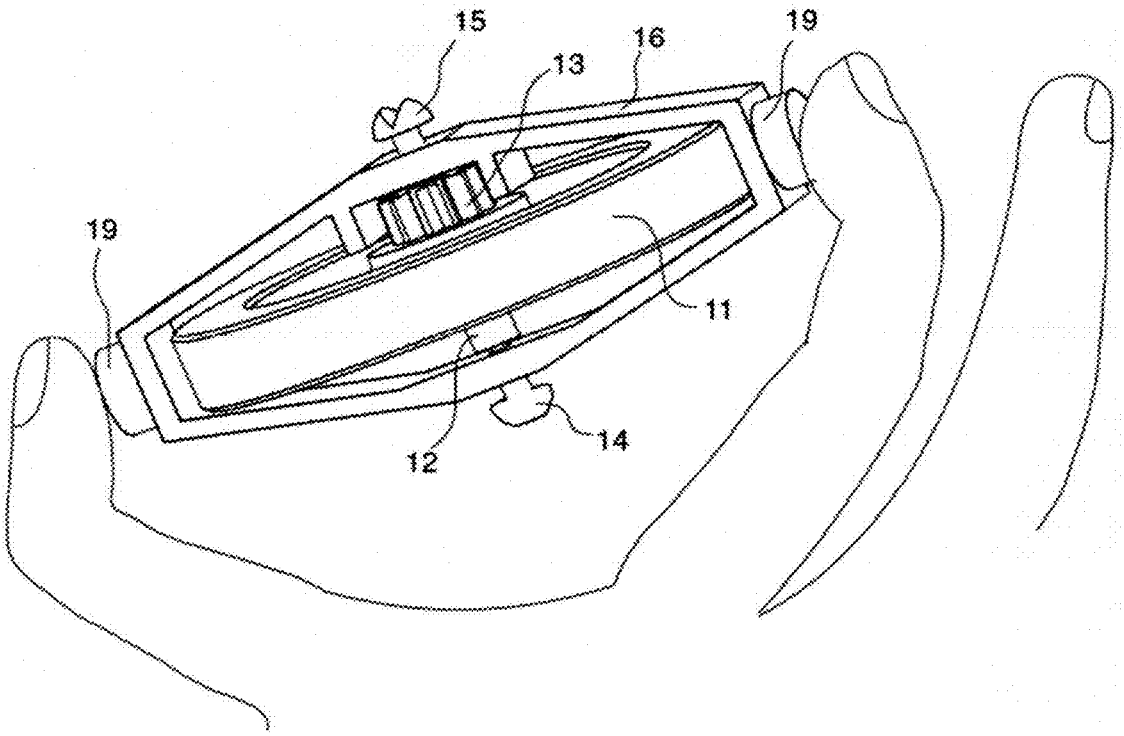
FIG. 5 is a perspective view of a portion of the gyroscopic curio of FIG. 1 being held.

When spun at high speed by the rip cord, the rotor 11 gains angular momentum that points along the axis of rotation. Referring to FIG. 5, the assembly can be held by two fingers by the two cylinders 19 on the sides of the gyroscope, with the cylinders 19 acting as side bearings allowing the device to be held in an axis perpendicular to the rotor axis free to spin in the hand. If the gyroscope is turned in any direction while the rotor 11 is spinning, a torque will be added to the system, with direction along the axis of the induced rotation. The angular momentum of the spinning rotor 11 and the added torque combine to cause the gyroscope assembly to spin about the axis of the two cylinders 19. Careful control of the added torque through the fingers can be used to control the direction and spin of the gyroscope about the cylinders 19 until friction slows the rotor down.

Figures 6A, 6B, 6C:
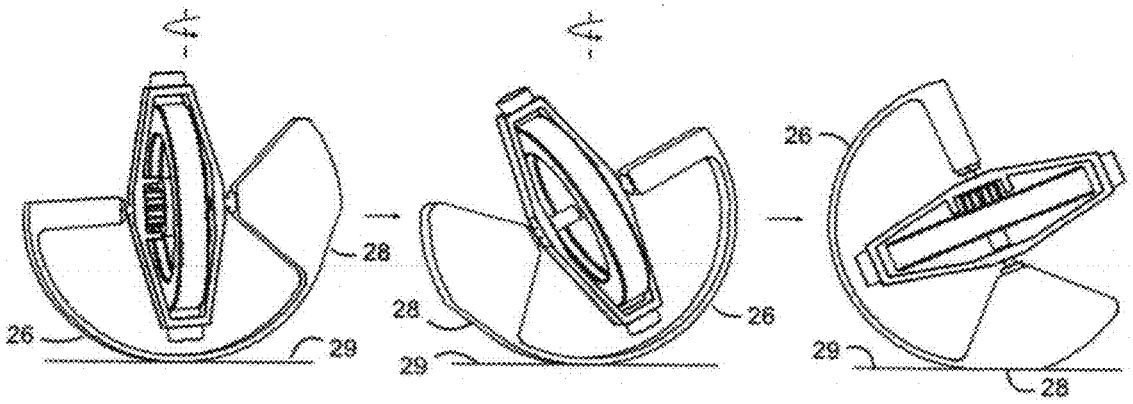
FIGS. 6A-6C are sequential perspective views of the gyroscopic curio of FIG. 1.

Referring to FIGS. 6A-6C, if the base 20 is placed on a ground surface 29 with its thin curved outer surface 26 in contact with the ground surface 29, the uneven center of gravity of the curio will cause the assembly to want to rotate down until the flattened surface section 28 is in contact with the ground 29. Similar to the case above, this rotation adds a torque to the system, and if the rotor 11 is spinning while the base 20 is attempting to rotate, the resulting combination will result in the base 20 rotating clockwise or counterclockwise if viewed from above, depending on the direction the rotor 11 is spinning. This movement will continue until friction in the system causes the rotor 11 to slow down, until the assembly eventually lands upright on the flattened surface section 28 of the thin curved outer surface 26 of the base.

Thus, an executive curio in accordance with the principals of the present invention provides a gyroscope with freely rotating sides and base for showing gyroscopic phenomenon. Gyroscopic phenomena can be manifested in multiple ways, but this phenomenon is unintuitive and difficult to explain. Commercially available gyroscopes only demonstrate this phenomenon in limited ways. The unintuitive nature of gyroscopic phenomenon and the limited capability of existing gyroscopes limit the ways in which this phenomenon can be understood and used to teach and entertain. The present invention uses the principles of physics along with the rotating sides and the rotating base to demonstrate gyroscopic phenomena in a way that can be seen and felt. Existing gyroscopes have remained virtually unchanged since their introduction to the public, using the same principle of a spinning top combined with a gimbal. The present invention improves the existing technology by adding freely rotating sides and the rotating base, which can be used to show the same principles of physics in new ways.

While an executive curio in accordance with the principals of the present invention has been described with specific embodiments, other alternatives, modifications, and variations will be apparent to those skilled in the art. For example, while the example embodiment described herein contains threaded connections other connections such as for example press fits and bearings could be utilized. In addition, a different powering mechanism such as a motor added to the rotor could be utilized to extending the time the phenomenon manifests itself. Accordingly, it will be intended to include all such alternatives, modifications and variations set forth within the spirit and scope of the appended claims.

What is claimed is:

1. A desk or executive curio comprising:

a rotor;

a housing defining a first inner pivoted support and a second inner pivoted support, the inner pivoted supports allow rotation of the rotor about an inner pivotal axis;

the housing further defining a first outer pivoted support and a second outer pivoted support, the outer pivoted supports allow rotation of the housing about an outer pivotal axis perpendicular to the inner pivotal axis of the rotor; and a base, the rotor and housing being removably connectable to the base by the first inner pivoted support and the second inner pivoted support along the inner pivotal axis, the base defining a curved bottom surface adapted to rest on a ground surface and having a flattened surface section thereof contained on a side of the base; and when the base, the rotor and the housing are connected, the curio having a center of gravity offset with respect to the center axis of the rotor and the housing to the side corresponding with the flattened surface section;

wherein, when activated with the curved bottom surface of the base placed on the ground surface, the offset center of gravity causes the curio to rotate until the flattened surface section is in contact with the ground surface.

2. The desk or executive curio of claim 1 wherein the inner pivoted supports comprise a shaft connected with the rotor, and gimbal shafts connected to the shaft.

3. The desk or executive curio of claim 2 comprising the rotor containing a gear, and wherein the shaft comprises a threaded shaft threaded into the rotor and the gear, and the gimbal shafts comprise threaded shafts connected to the threaded shaft.

4. The desk or executive curio of claim 2 wherein the rotor and housing are removably connectable to the base by the gimbal shafts being spring fitted into cutouts defined in two flat parallel sides protruding into the center of the base.

5. The desk or executive curio of claim 1 wherein the outer pivoted supports comprise side bearings press fit onto side shafts and cylinders press fit over the side bearings.

6. The desk or executive curio of claim 1 wherein the rotor further comprises a gear connected to the rotor and a rip cord having a long rack gear adapted to be used with the gear to impart a high speed spin of the rotor.

7. A desk or executive curio comprising:

a rotor assembly comprising a rotor and a shaft;

a housing assembly defining a first inner pivoted support and a second inner pivoted support, the inner pivoted supports allow rotation of the rotor assembly about an inner pivotal axis;

the housing assembly further defining a first outer pivoted support and a second outer pivoted support, the outer pivoted supports allow rotation of the housing assembly about an outer pivotal axis perpendicular to the inner pivotal axis of the rotor assembly;

a base defining a curved bottom surface adapted to rest on a ground surface and having a flattened surface section thereof contained on a side of the base;

when the base, the rotor and the housing are connected, the curio having a center of gravity offset with respect to the center axis of the rotor and the housing to the side corresponding with the flattened surface section; and the rotor assembly and the housing assembly being removably connectable to the base by the first inner pivoted support and the second inner pivoted support along the inner pivotal axis;

wherein, when activated with the curved bottom surface of the base placed on the ground surface, the offset center of gravity causes the curio to rotate until the flattened surface section is in contact with the ground surface.

8. The desk or executive curio of claim 7 wherein the inner pivoted supports comprise the shaft connected with the rotor, and gimbal shafts connected to the shaft.

9. The desk or executive curio of claim 8 wherein the shaft comprises a threaded shaft threaded into the rotor and the gimbal shafts comprise threaded shafts connected to the threaded shaft.

10. The desk or executive curio of claim 8 wherein the rotor assembly and the housing assembly are removably connectable to the base by the gimbal shafts being spring fitted into cutouts defined in two flat parallel sides protruding into the center of the base.

11. The desk or executive curio of claim 7 wherein the outer pivoted supports comprise side bearings press fit onto side shafts and cylinders press fit over the side bearings.

12. The desk or executive curio of claim 8 wherein the rotor further comprises a gear connected to the rotor and a rip cord having a long rack gear adapted to be used with the gear to impart a high speed spin of the rotor.

* * * * *